US008745910B2

(12) United States Patent
Zukowski et al.

(10) Patent No.: US 8,745,910 B2
(45) Date of Patent: Jun. 10, 2014

(54) ROTATING AND TRANSLATING EXTRACTOR MECHANISM

(75) Inventors: Gary Zukowski, Ludlow, MA (US); Brett Curry, Monson, MA (US); Sean O'Clair, Feeding Hills, MA (US)

(73) Assignee: Smith & Wesson Corp., Springfield, MA (US)

( * ) Notice: Subject to any disclaimer, the term of this patent is extended or adjusted under 35 U.S.C. 154(b) by 108 days.

(21) Appl. No.: 13/296,332

(22) Filed: Nov. 15, 2011

(65) Prior Publication Data

US 2012/0167427 A1 Jul. 5, 2012

Related U.S. Application Data

(60) Provisional application No. 61/428,025, filed on Dec. 29, 2010.

(51) Int. Cl.
*F41A 15/00* (2006.01)

(52) U.S. Cl.
USPC ..... 42/25

(58) Field of Classification Search
USPC ..... 42/16, 25, 46, 47
See application file for complete search history.

(56) References Cited

U.S. PATENT DOCUMENTS

| | | | | |
|---|---|---|---|---|
| 1,401,552 | A * | 12/1921 | Pedersen | 89/183 |
| 1,423,836 | A * | 7/1922 | Declaye | 89/4.5 |
| 3,608,223 | A * | 9/1971 | Dieckmann | 42/25 |
| 5,678,340 | A * | 10/1997 | Moon | 42/25 |
| 5,794,373 | A * | 8/1998 | Moon | 42/25 |
| 6,851,212 | B2 * | 2/2005 | Szabo | 42/25 |
| 7,380,362 | B2 | 6/2008 | Curry et al. | |

* cited by examiner

*Primary Examiner* — Gabriel Klein
(74) *Attorney, Agent, or Firm* — Ballard Spahr LLP

(57) ABSTRACT

An extractor mechanism for a firearm includes a firearm slide having a pocket, the pocket extending in a longitudinal direction substantially parallel to a firing axis of a firearm and having an opening proximate to a breech face of the slide, and an extractor arm having a body portion and a hook portion, the body portion being disposed at least partially within the pocket and the hook portion extending at least partially out of the opening and having a distal edge sized to engage a cartridge rim, wherein the extractor arm is pivotally and slidably mounted to the slide such that the hook portion is capable of being pivoted toward and away from the firing axis and the extractor arm is capable of translational movement with respect to the slide in a direction substantially parallel to the firing axis.

15 Claims, 5 Drawing Sheets

ROTATING AND TRANSLATING EXTRACTOR MECHANISM

CROSS REFERENCE TO RELATED APPLICATIONS

This application claims the benefit of U.S. Provisional Application Ser. No. 61/428,025, filed on Dec. 29, 2010, which is herein incorporated by reference in its entirety.

FIELD OF THE INVENTION

The present invention relates to auto-loading firearms and, more particularly, to extractor mechanisms for use in auto-loading firearms.

BACKGROUND OF THE INVENTION

Most auto-loading firearms include a frame or receiver, a barrel mounted to the frame or receiver, and a slide or bolt movably mounted to the frame or receiver for reciprocating motion to lock or open a chamber formed in the barrel. During discharge of such a firearm, the slide or bolt is locked against the chamber. Following discharge of the firearm, the slide or bolt retracts to extract the discharged or spent round from the chamber.

One type of extractor mechanism includes a substantially flat steel member that is mounted to the slide or bolt. A hook or claw is positioned on the forward end of the member to engage the rim of the spent round while the round is locked within the chamber of the firearm. When engaged, the hook positions the rim of the casing in a space between the hook and a breech face of the slide or bolt. Upon operation of the firearm, the firing pin or striker projects from the breech face to detonate the primer of the round, thus igniting propellant to discharge a bullet down the barrel.

Upon discharge of the round or cartridge (or by manually drawing the slide or bolt from its forward (battery) position to its rearward (retired) position), the extractor hook grips the rim of the round to pull the round from the chamber. By interaction with an ejector mechanism housed or formed in the bolt, frame, or receiver, the extractor hook or claw holds the round in position to be hit by the ejector. The ejector holds the round in a stationary position as the slide continues rearward, the round rotates about the extractor and then launches out through the ejection port formed in the frame, slide, or receiver, thereby clearing the round from the firearm to permit loading a next round.

Typically, the next round is supported by a magazine at a feed opening disposed rearward from and below the chamber. As the bolt or slide of the firearm moves forward from its retired position, the rim of the round is caught between the breech face and the extractor claw, and the round is swept from the magazine feed opening into the chamber. As will be readily appreciated, however, the smaller the gap between the extractor claw, the greater the chance that the extractor could hinder the chambering of the round.

Thus, a dimension from the breech face to the extractor hook is important to the operation of the gun. At the beginning of the loading operation, it is advantageous to have this dimension as large as possible so that the rim of the round can easily pass between the breech face and the extractor claw and into position within the chamber. Given the geometry of pistol cartridges, however, this dimension (breech face to extractor hook) is typically limited.

Accordingly, a need exists for an extractor hook that can provide optimal clearances from a breech face during loading, firing, and ejection of a round.

SUMMARY OF THE INVENTION

In view of the foregoing, it is an object of the present invention to provide an extractor mechanism for a semi-automatic firearm, with an extractor arm having a body portion and a hook portion. The extractor arm is preferably pivotally and slidably mounted within a pocket of a firearm slide with the hook portion extending out of the pocket from an opening proximate to the slide's breech face. A distal edge of the hook portion is sized to engage a cartridge rim.

In one embodiment, the operation of the extractor mechanism is enhanced by providing an extractor arm that is both pivotally and slidably mounted within a pocket formed in the slide, which permits a dimension from the breech face to the extractor hook to be varied.

An advantage provided by various embodiments of the present invention is that the reliability of the cycling and ejection functions of a handgun is improved. In particular, by allowing the dimension from the breech face to the extractor hook to be varied during operation, transitioning of a round from the magazine to the chamber in the barrel is facilitated.

These and other objects, features and advantages of the present invention will become apparent in light of the detailed description of the best mode embodiment thereof, as illustrated in the accompanying drawings.

DESCRIPTION OF PREFERRED EMBODIMENTS

Figure 1:
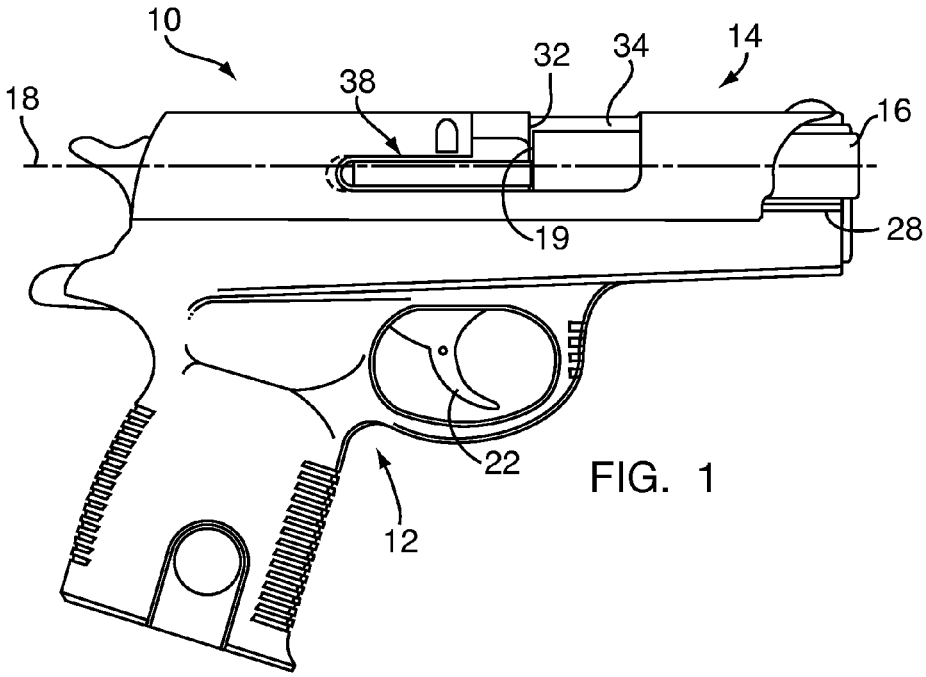
FIG. 1 is a simplified schematic view of a pistol shown with an extractor mechanism of the present invention.
Figure 2:
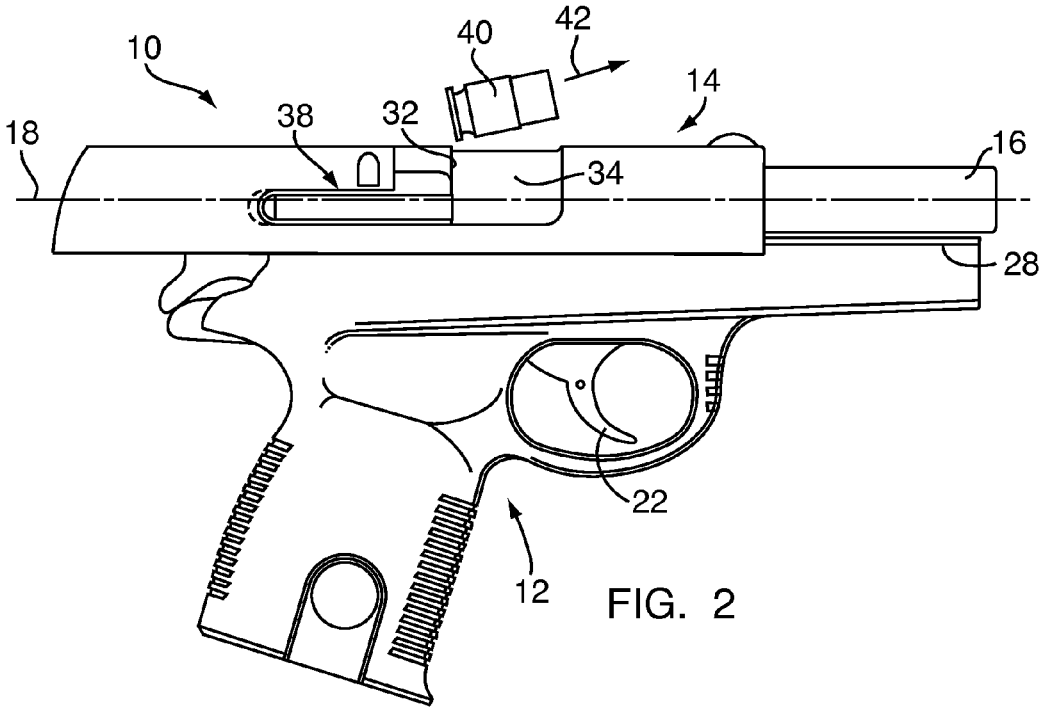
FIG. 2 is a simplified schematic view of the pistol of FIG. 1 shown with the slide moved to a rearward position on the pistol frame.

Referring to FIGS. 1 and 2, a semiautomatic pistol or handgun is shown generally at 10 and is hereinafter referred to as "handgun 10." The handgun 10 comprises a frame assembly 12, a slide 14, a barrel 16, and a firing mechanism. The frame assembly 12 is fabricated of a high-impact polymer material, metal, or a combination of polymer and metal. The barrel 16 is disposed in the forward end of the slide 14, is cooperatively linked therewith, and, together with the slide 14, defines a longitudinal firing axis 18. A rearward end 19 of the barrel 16 is adapted for receiving an ammunition cartridge. A trigger 22 is pivotally mounted to the frame assembly 12 to actuate the firing mechanism and fire the handgun 10. The firing mechanism acts on a firing pin that is generally centered on the firing axis 18 and biased in a rearward direction by a firing spring, in the handgun shown. Other types of firing mechanisms are employed in semiautomatic handguns, as is well known to those skilled in the art. The present invention is not limited to a particular type of semiautomatic firing mechanism.

The slide 14 is fitted to opposingly-positioned rails 28 of the frame assembly 12 to effect the reciprocal movement of the slide 14 along the longitudinal firing axis 18. The slide 14 is cooperative with the rails 28 of the frame assembly 12 to allow the cycling of the slide 14 between forward (battery) and rearward (retired) positions. The slide 14 further includes a breech face 32 and an extractor port 34. The breech face 32 is engagable with the rearward end 19 of the barrel 16 to form a firing chamber when the slide 14 is disposed forwardly on the frame assembly 12. An ejector mechanism, generally 38, provides for the ejection of a cartridge casing 40.

For the present type of firearm, the cooperation of the frame assembly 12, the slide 14, and the firing mechanism during the loading, firing, and ejecting of a cartridge casing 40 can be understood by referring to U.S. Pat. No. 5,086,579 titled "DECOCKING MECHANISM FOR A SEMI-AUTOMATIC FIREARM"; U.S. Pat. No. 5,386,659 titled "FIRE CONTROL MECHANISM FOR SEMIAUTOMATIC PISTOLS"; U.S. Pat. No. 5,406,731 titled "HANDGUN OF IMPROVED ERGONOMIC CONSTRUCTION"; and U.S. Pat. No. 7,380,362, titled "FIREARM EXTRACTOR MECHANISM", all of which are owned by the Assignee and are incorporated by reference herein.

Figure 3:
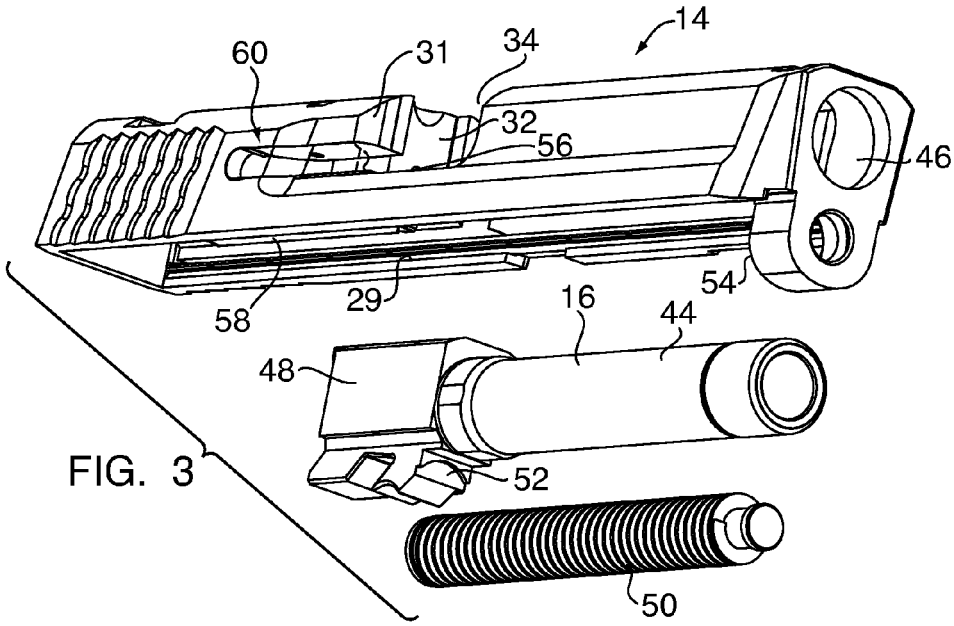
FIG. 3 is a simplified schematic exploded perspective view of the slide, the barrel, and the recoil spring of the pistol shown in FIGS. 1 and 2.

Referring now to FIG. 3, the slide 14, in the semiautomatic handgun shown, is an elongated box-like structure having a rearward end that is enclosed to house the firing pin and an open forward end in which the barrel 16 is mounted. The rails 28 are engaged by surfaces 29 extending from the forward end of the slide 14 to the rearward end of the slide 14. The barrel 16 includes a tubular portion 44 that is receivable through an aperture 46 at the forward end of the slide 14 and a rear portion 48 that, when the barrel 16 is positioned in the slide 14, closes the extractor port 34. The slide 14 and the barrel 16 are linkably connected such that when the slide 14 is cycled in the rearward direction, the barrel 16 unlinks therefrom. A recoil spring 50 is operatively engaged with the barrel 16. The operative engagement of the recoil spring 50 with the barrel 16 is effected by the engagement of one end of the recoil spring 50 with a surface on the receiver and by the engagement of the other end of the recoil spring 50 with a surface 54 on the slide 14.

The forward-most portion of the closed rearward end of the slide 14 includes a breech block 31 defining a breech face 32. The breech face 32 includes an opening 56 through which the forward end of the firing pin is received to strike the cartridge and fire the handgun. The undersurface of the closed rearward end of the slide 14 also includes a pickup rail 58 that, upon operation of the handgun, strips cartridges from a magazine and urges the cartridges into a firing position.

The ejector mechanism (shown at 38 in FIGS. 1 and 2) includes an extractor mechanism/means 60 mounted on an inner surface of the slide 14 proximate the breech face 32 and a shoulder (not shown) disposed on the frame assembly. The extractor mechanism 60 is laterally displaced from the firing axis and is positioned so as to be horizontal relative to the firing axis. Upon cycling of the slide, the extractor mechanism 60 cooperates with the shoulder to eject cartridges or spent cartridge casings. When the slide 14 is moved to a retired position, the firing chamber is exposed through the extractor port 34, and the shoulder acts with the extractor mechanism 60 to engage the casing and eject it from the firing chamber through the extractor port 34.

Figure 4:
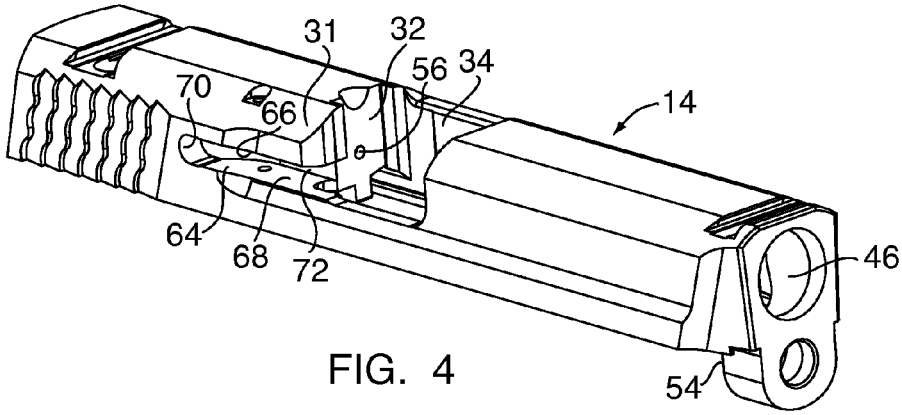
FIG. 4 is a simplified schematic perspective view of the slide showing the breech face and the pocket in which the extractor mechanism is housed.
Figure 5:
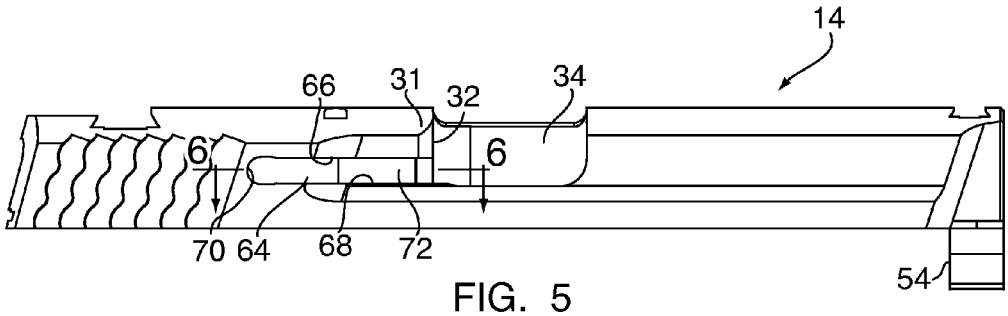
FIG. 5 is a simplified schematic side elevational view of the slide showing the pocket in which the extractor mechanism is housed.
Figure 6:
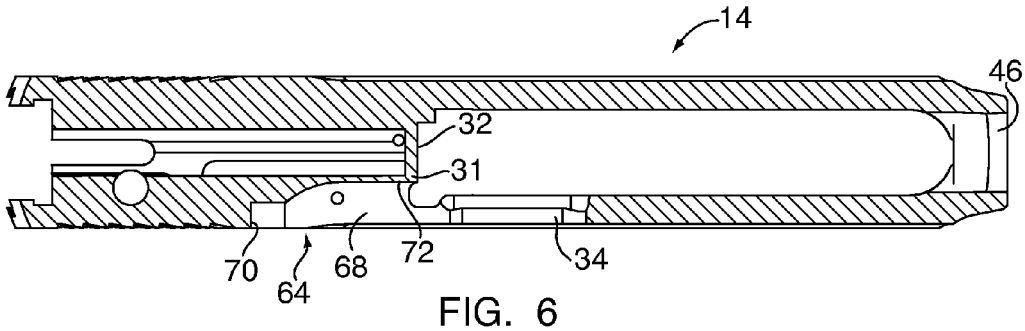
FIG. 6 shows a simplified schematic plan view of the pocket in which the extractor mechanism is housed.

Referring now to FIGS. 4-6, a cavity or pocket 64 is formed in a side wall of the slide 14 to accommodate the extractor arm 80. The pocket 64 includes an upper pocket surface 66, a lower pocket surface 68, and a contoured end 70. The upper pocket surface 66 and the lower pocket surface 68 are parallel and spaced to receive the extractor mechanism in a close-tolerance fit. As can be best seen in FIGS. 5 and 6, the upper pocket surface 66 and the lower pocket surface 68 are connected by a side surface 72 of the breech block 31.

Figure 7:
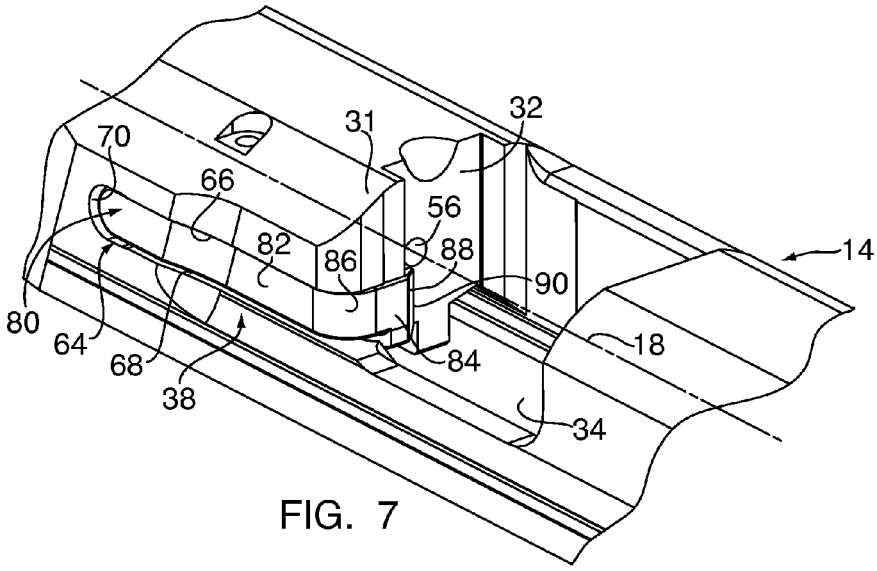
FIGS. 7 and 8 are simplified schematic perspective views of the extractor mechanism.
Figure 8:
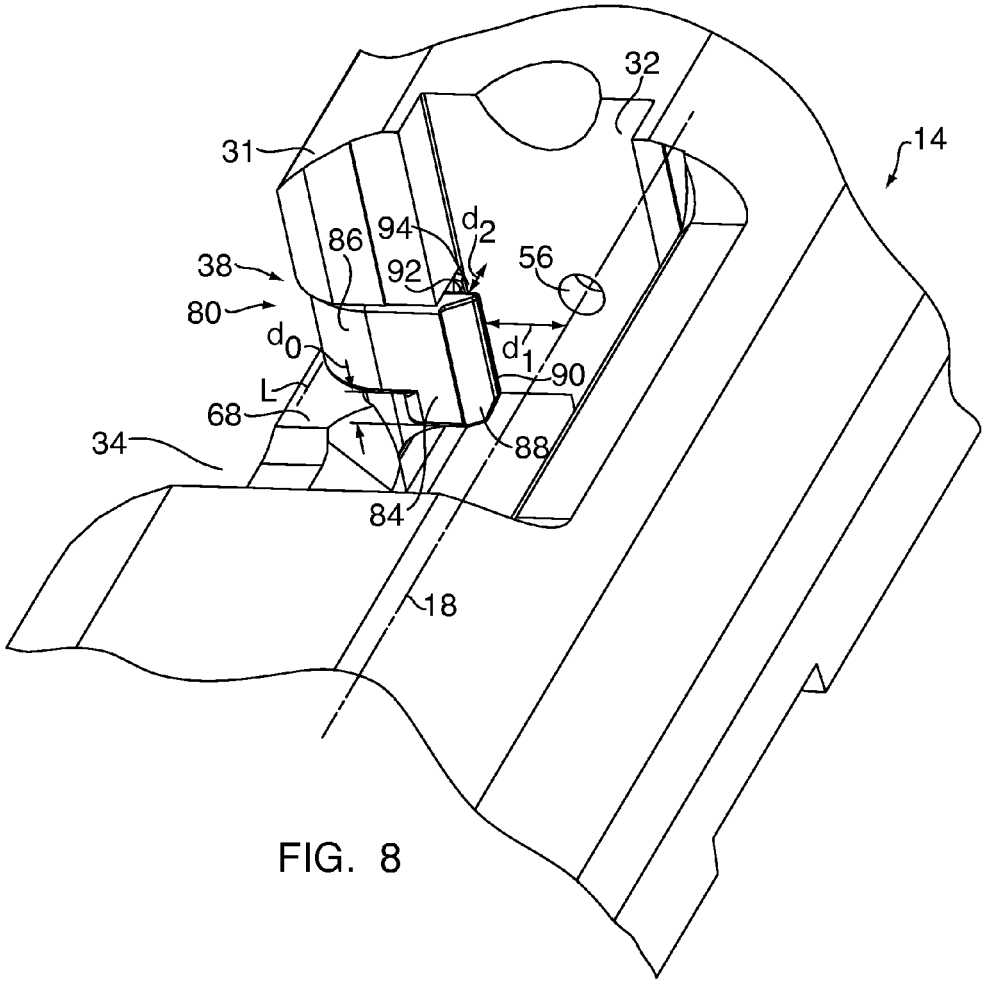

FIGS. 7 and 8 show details of the extractor claw or mechanism 60 discussed above. As shown therein, the extractor mechanism 60 comprises an extractor arm 80, which is positioned in the pocket 64 as shown. The extractor arm 80 comprises a body portion 82 and a hook portion 84. When positioned in the pocket, the body portion 82 extends substantially parallel to and offset from the longitudinal firing axis 18. The forward end of the body portion 82 extends around the corner defined by the breech face 32 and a side surface of the breech block 31 to terminate in the hook portion 84 that engages a rim of the casing of a cartridge. To provide strength to the extractor arm 80, the body portion 82 and the hook portion 84 are formed from a single piece of metal, and the transition portion from the body portion 82 (whose height lies in a plane substantially parallel to the firing axis) along the length of the slide 14 to the hook portion 84 (whose height lies in a plane substantially perpendicular to the firing axis) comprises a curved surface 86. Preferably this curved transition portion 86 forms a smooth curve from the plane of the body portion to the plane of the hook portion.

The hook portion 84 includes a hook 88 that depends from the forward end of the body portion 82 in a direction generally perpendicular to the longitudinal firing axis 18. The hook 88 is defined by at least two surfaces arranged to form an acute angle and that meet at an edge 90. The edge 90 is configured to facilitate movement of the hook portion 84 over the rim of a cartridge, points toward the longitudinal firing axis 18, and is spaced a distance $d_1$ therefrom. A hook face 92 is oriented substantially parallel to the breech face 32 and is spaced axially a distance $d_2$ therefrom to define a space 94.

Preferably, but without limitation to the inventive subject matter herein, the hook 88 is furthermore configured to extend in a downward direction a distance $d_o$ away from a major axis L of the body portion 82. The extension of the hook 88 in the downward direction facilitates the engagement of the hook 88 with the cartridge. In other words, the height of the hook portion 84 in a plane substantially perpendicular to the firing axis 18 is greater than the height of the body portion 82 in a plane parallel to the firing axis.

Figure 9:
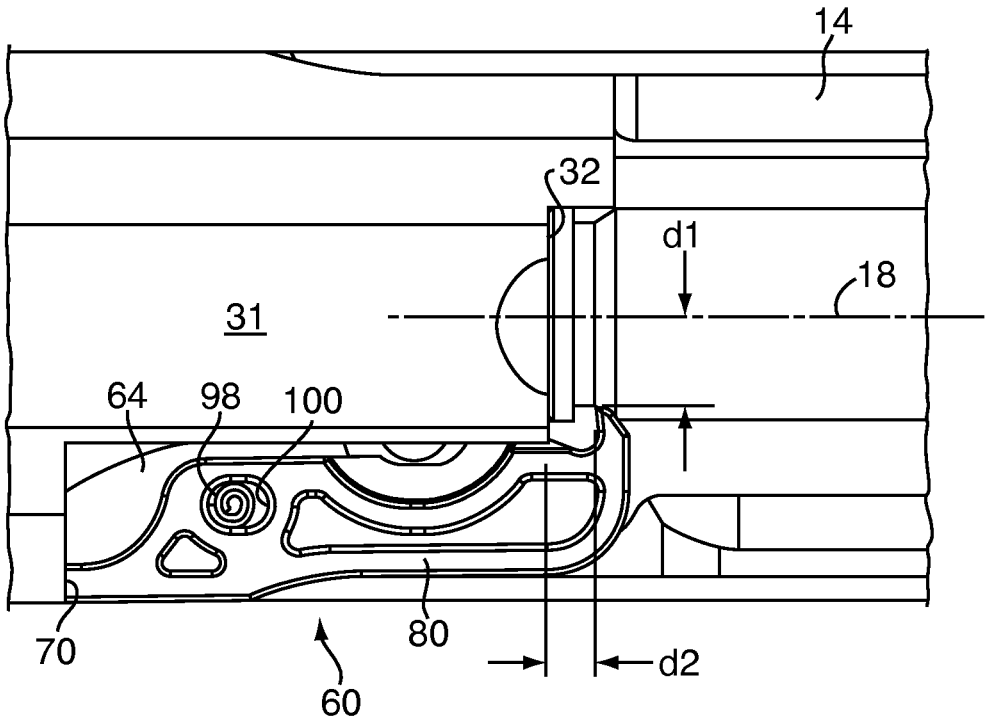
FIG. 9 shows a simplified schematic plan view of the extractor mechanism housed in the slide.

Referring now to FIG. 9, the extractor arm 80 is preferably pivotally and slidably mounted in the pocket 64. In particular, as shown therein, the extractor arm 80 is carried on an extractor mount pin 98 extending through an elongated opening 100 formed in the extractor arm 80. The extractor arm 80 is dimensioned according to standards known in the art that consider the type and caliber of firearm in which the components indicative of those described herein are used. The extractor mount pin 98 is press fitted vertically through the upper surface and the lower surface of the pocket 64 and fits loosely within the extractor in arm 80 in a direction parallel to the firing axis 18 because of the longitudinal extent of the elongated opening 100 in the extractor arm 80, but holds tightly to the extractor arm 80 in a direction perpendicular to the firing axis 18 because of the lateral extent of the elongated opening 100. This provides a sliding friction fit within the elongated opening 100 to allow rotational movement of the extractor arm 80 about the extractor mount pin 98, and translational movement of the extractor arm 80 with respect to the slide 14 within the pocket 64 in a plane substantially perpendicular to the breech face 32 and parallel to the longitudinal firing axis 18.

As discussed above, during the cycling of the firearm 10, a round must transition from the magazine to the chamber within the barrel 16. In order for this to occur, the round must be fed up the breech face 32 behind the extractor hook 84. In operation, as the round is fed from the magazine to the chamber, the extractor 60 may translate forward by way of the elongated opening 100 and pivot pin 98 configuration to allow for greater clearance on its way into the chamber. As will be readily appreciated, this allows for easier feeding of a round from a magazine to the chamber. When the slide returns to battery position, it proceeds to push the extractor 60 back to a closed position.

The distances $d_1$ and $d_2$ provide for the consistent, reliable operation of the handgun, including proper and consistent loading and extraction of cartridges 40. Importantly, as a result of the elongated opening 100 formed within the extractor arm 80, the distance $d_2$ may advantageously vary according to mutual positioning of the slide 14, the cartridge 40, and the barrel 16. For example, thus, the dimensions of the elongated opening 100 are chosen according to relative dimensions of the slide, the barrel, and the cartridge. By way of example, without limitation, the cartridge headspace specification and the cartridge rim and body diameters are important parameters for determining the dimensions of the elongated opening 100.

In an embodiment, the extractor mount pin/pivot pin 98 has a coil spring disposed about the pivot pin 98 in the elongated opening 100 in the extractor arm 80. The coil spring functions to bias the hook 84 toward the firing axis 18.

Thus, in an embodiment of the present invention, a semi-automatic handgun comprises a frame, a slide reciprocatingly mounted on the frame, and a barrel mounted inside the slide. The slide comprises an elongated structure having a forward end for housing the barrel and a rearward end in which is housed a firing pin mechanism that cooperates with a trigger assembly and a fire control assembly mounted in the frame. The elongated structure of the slide includes an extractor mechanism having an arm. A body portion of the arm extends parallel to a longitudinal firing axis of the handgun, and includes an elongated opening for receiving an extractor spring carried on an extractor mount pin. The elongated opening advantageously enhances operation of the extractor mechanism for loading and ejecting a cartridge, as discussed in detail above.

Although this invention has been shown and described with respect to the detailed embodiments thereof, it will be understood by those of skill in the art that various changes may be made and equivalents may be substituted for elements thereof without departing from the scope of the invention. Particularly, the present invention is not limited to a particular structure and arrangement of the slide components surrounding the extractor mechanism.

In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. An extractor mechanism for a firearm, said mechanism comprising:

a firearm slide having a pocket, said pocket extending in a longitudinal direction substantially parallel to a firing axis of a firearm and having an opening proximate to a breech face of said slide; and an extractor arm having a body portion and a hook portion, said body portion being disposed at least partially within said pocket and said hook portion extending at least partially out of said opening and having a distal edge sized to engage a cartridge rim; wherein said extractor arm is pivotally and slidably mounted to said slide such that said hook portion is capable of being pivoted toward and away from said firing axis and said extractor arm is capable of translational movement with respect to said slide in a direction substantially parallel to said firing axis wherein said body portion has a body height in a first plane substantially parallel to said firing axis and said hook portion has a hook height in a second plane substantially perpendicular to said firing axis, said body portion and said hook portion being connected by a curved transition portion, and wherein said body portion, hook portion, and curved transition portion share a common upper surface defined by and lying coterminous with a third plane that is lateral to said extractor arm, and said body portion and said curved transition portion share a common lower surface defined by and lying coterminous with a fourth plane that is lateral to said extractor arm, said third and fourth planes being parallel to one another, with a lower bound of said hook portion extending below the fourth plane.

2. The extractor mechanism of claim 1, wherein said extractor arm is pivotally and slidably mounted to said slide about a pivot pin connected to said slide, said pivot pin fitting loosely within said extractor arm in a direction parallel to said firing axis and fitting tightly in said extractor arm in a direction perpendicular to said firing axis.

3. The extractor mechanism of claim 2, wherein said pivot pin is received in an elongated aperture in said extractor arm, said elongated aperture having a longitudinal dimension extending parallel to said longitudinal firing axis and a lateral dimension extending perpendicular to said longitudinal firing axis, said longitudinal dimension being greater than said lateral dimension.

4. The extractor mechanism of claim 2, further comprising a biasing means operatively associated with said extractor arm for biasing said hook portion toward said firing axis.

5. The extractor mechanism of claim 4, wherein said biasing means is a coil spring positioned rearward of the pivot pin.

6. The extractor mechanism of claim 1, wherein:

a first and second surface of said hook portion meet at said distal edge, said first surface being arranged in a plane substantially parallel to said breech face, said second surface being arranged in a plane that diverges from said breech face at an acute angle, said first surface being more proximate to said breech face than said second surface;

whereby said distal edge facilitates movement of said hook portion over a cartridge rim.

7. The extractor mechanism of claim 1, wherein:

said body portion has a body height which lies in a plane substantially perpendicular to said firing axis;

said hook portion has a hook height which lies in said plane substantially perpendicular to said firing axis; and said hook height exceeds said body height.

8. An extractor mechanism for a firearm, said mechanism comprising:

a firearm slide having a pocket, said pocket extending in a longitudinal direction substantially parallel to a firing axis of a firearm, and having an opening proximate to a breech face of said slide; and an extractor arm having an elongate body portion and a hook portion, said body portion being disposed at least partially within said pocket and having a first distal end and a second distal end, said body portion and said hook portion being connected by a curved transition portion, and said hook portion extending at least partially out of said opening and having a distal edge sized to engage a cartridge rim; wherein said body portion of said extractor arm is pivotally and slidably mounted to said slide in said pocket about a pivot pin connected to said slide at a point between said first and second distal ends, such that said hook portion is capable of being pivoted toward and away from said firing axis, and said body portion is capable of being translated with respect to said slide in a direction substantially parallel to said firing axis wherein said body portion, hook portion and curved transition portion share a common upper surface defined by and lying coterminous with a first plane that is lateral to said extractor arm, and said body portion and said curved transition portion share a common lower surface defined by and lying coterminous with a second plane that is lateral to said extractor arm, said first and second planes being lateral to one another, with a lower bound of said hook portion extending below said second plane.

9. The extractor mechanism of claim 8, wherein said pivot pin is received in an elongated aperture in said body portion of said extractor arm, said pivot pin fitting loosely within said aperture of said extractor arm in a direction parallel to said firing axis and fitting tightly in said extractor arm in a direction perpendicular to said firing axis.

10. The extractor mechanism of claim 9, wherein said elongated aperture has a longitudinal dimension extending parallel to said longitudinal firing axis and a lateral dimension extending perpendicular to said longitudinal firing axis, said longitudinal dimension being greater than said lateral dimension.

11. The extractor mechanism of claim 8, further comprising a biasing mechanism operatively associated with said extractor arm for biasing said hook portion toward said firing axis.

12. The extractor mechanism of claim 11, wherein said biasing mechanism comprises a coil spring and said pivot pin.

13. The extractor mechanism of claim 10, wherein said pivot pin is a spring pin.

14. The extractor mechanism of claim 12, wherein:

a first and second surface of said hook portion meet at said distal edge, said first surface being arranged in a plane substantially parallel to said breech face, said second surface being arranged in a plane that diverges from said breech face at an acute angle, said first surface being more proximate to said breech face than said second surface; whereby said distal edge facilitates movement of said hook portion over a cartridge rim.

15. The extractor mechanism of claim 8, wherein:

said body portion has a body height in a first plane substantially parallel to said firing axis and said hook portion has a hook height in a second plane substantially perpendicular to said firing axis;

and wherein said hook height exceeds said body height.

* * * * *